United States Patent [19]

Barnes

[11] Patent Number: 4,981,606

[45] Date of Patent: Jan. 1, 1991

[54] LIQUID CLEANING PRODUCTS COMPRISING ORGANIC PEROXYACID BLEACHING AGENTS AND CONTAINING CAPPED ALKOXYLATED NONIONIC SURFACTANTS

[75] Inventor: Stephen G. Barnes, South Wirral, England

[73] Assignee: Lever Brothers Company, Division of Conopco, Inc., New York, N.Y.

[21] Appl. No.: 337,519

[22] Filed: Apr. 13, 1989

[30] Foreign Application Priority Data

Apr. 29, 1988 [GB] United Kingdom ..... 8810195

[51] Int. Cl.[5] ..... C11D 3/395

[52] U.S. Cl. ..... 252/95; 252/186.42

[58] Field of Search ..... 252/95, 104, DIG. 14, 252/186.42

[56] References Cited

U.S. PATENT DOCUMENTS

| | | | |
|---|---|---|---|
| 3,061,552 | 10/1962 | Schenck et al. | 252/174.21 |
| 3,128,250 | 4/1964 | Lintner | 252/99 |
| 3,130,169 | 4/1984 | Blumbergs | 252/186 |
| 3,444,242 | 5/1969 | Rue et al. | 252/174.21 |
| 3,956,159 | 5/1976 | Jones | 252/104 |

FOREIGN PATENT DOCUMENTS

| | | |
|---|---|---|
| A-30096 | 6/1981 | European Pat. Off. . |
| 0266199 | 5/1988 | European Pat. Off. . |
| 2182051 | 5/1987 | United Kingdom . |

OTHER PUBLICATIONS

N. Schonfeldt, "Surface Active Ethylene Oxide Adducts", p. 660, Pergamon, N.Y. (1969).

*Primary Examiner*—Paul Lieberman
*Assistant Examiner*—John F. McNally
*Attorney, Agent, or Firm*—Ronald A. Koatz

[57] ABSTRACT

A substantially non-aqueous liquid cleaning product composition comprising:

(a) a liquid solvent phase comprising from 0.1 to 50% by weight based on the weight of the solvent phase of surfactant material, the balance of the solvent phase consisting of non-surfactant organic solvent, said surfactant material comprising a capped alkoxylated nonionic surfactant; and (b) at least 0.1% of an organic peroxyacid dissolved in said solvent phase;

said composition comprising substantially no undissolved peroxyacid, at least 30% by weight of the peroxyacid remaining after two months storage at 25° C.

8 Claims, No Drawings

LIQUID CLEANING PRODUCTS COMPRISING ORGANIC PEROXYACID BLEACHING AGENTS AND CONTAINING CAPPED ALKOXYLATED NONIONIC SURFACTANTS

The present invention relates to substantially non-aqueous liquid cleaning products which contain bleach and which are especially, although not exclusively, intended for application direct to the article or surface to be cleaned, without prior wetting with water.

A primary intended use of products according to the present invention is pre-treatment of stained fabrics before the fabrics are subjected to washing by hand or in a washing machine. They may also be applied direct to hard surfaces, to dishes, cutlery and the like prior to hand or machine washing, or in specialised cleaning applications such as for surgical instruments or artificial dentures.

It is known to incorporate solid bleaches as dispersions in non-aqueous liquid products, for example as described in patent specification EP-A- No. 30,096 (ICI). These are inorganic persalt bleaches. Peroxyacids have also been incorporated, suspended as solids in aqueous liquids, for example as described in patent specification EP-A-No. 201,958 (Akzo). Unfortunately, application of the bleach in the form of a solid, albeit suspended or dispersed in a liquid medium, does not make it immediately available to exert its action unless the article or surface in question is pre-wetted with water. Such pre-wetting is inconvenient and does not provide optimum performance.

It is also highly desirable for pre-treatment products to contain non-surfactant solvents since they are useful in promoting removal of oily or greasy soil. It is know, according to the disclosure of U.S. Pat. No. 3,130,169 (FMC) to dissolve peroxyacids in non-surfactant solvents.

However, the compositions according to the latter reference, are totally devoid of surfactant. Surfactant is also an eminently desirable component of such compositions for immediate enhancement of cleaning and, where appropriate, loosening or solubilisation of soil prior to a main washing process.

It is likely that the compositions of U.S. Pat. No. 3,130,169 lack surfactant because of the well known incompatibility of peroxyacids and surfactants, for example as described in the introduction of patent specification GB-A-No. 2,182,051 (Interox).

Surprisingly we have now found that we can incorporate dissolved peroxyacid bleaches in liquid cleaning products containing both surfactant and non-surfactant solvent if such product compositions are formulated so as to comprise a specific class of surfactant.

Thus, according to the invention, there is provided a substantially non-aqueous liquid cleaning composition comprising:

(a) a liquid phase comprising from 0.1 to 50% by weight based on the weight of the liquid phase of surfactant material, the balance of the liquid phase comprising a non-surfactant organic solvent, said surfactant material comprising a capped alkoxylated nonionic surfactant; and (b) at least 0.1% of an organic peroxyacid dissolved in said liquid phase;

said composition comprising substantially no undissolved peroxyacid.

The compositions of the present invention contain substantially no undissolved peroxyacid and after 2 months storage at 25° C., at least 30% by weight of the peroxyacid remains. Although this peroxyacid stability may not be quite as high as could be obtained in the total absence of surfactant, it is significantly better than would be expected with uncapped surfactants.

Preferably, the liquid phase contains from 5% to 40% by weight, most preferably from 10% to 30%, of surfactant material. For optimum stability it is also preferred that at least half, or more preferably, substantially all of the surfactant material consists of one or more of capped alkoxylated nonionic surfactants.

The capped alkoxylated nonionic surfactants comprise a saturated or unsaturated linear or branched fatty chain liked via one or more independently selected alkyleneoxy, e.g. $C_{1-4}$ alkyleneoxy groups to a terminal group which is other than hydrogen. This terminal or 'capping' group may be aliphatic or aryl, for example a long-chain alkyl or alkenyl group having from 5 to 15 carbon atoms, an alkyl group of 1 to 4 carbon atoms or a benzyl group. The surfactants capped with the $C_{1-4}$ alkyl, especially methyl groups, are most preferred.

By way of example, the capped alkoxylated nonionic surfactants may have any structure according to the following general formula:

$$RO(C_2H_4O)_p(C_3H_6O)_qR^1$$

wherein R represents a straight or branched primary or aliphatic hydrocarbon group, for example alkenyl, or more preferably alkyl, of from 8 to 24, e.g. from 10 to 15 carbon atoms, p is from 2 to 14, preferably 3 to 11, q is from 0 to 8, and $R^1$ is a capping group other than hydrogen, for example as hereinbefore described.

Most preferred are the solely ethoxylated capped nonionics, for example those of the above general formula wherein q represents zero.

The organic non-surfactant solvent may be chosen form a very wide range of such surfactants and combinations thereof. For example they may be chosen from the organic solvents and organic solvent combinations described in U.S. Pat. Nos. 3,130,169 (FMC), 3,956,159 (Procter & Gamble) and 4,176,080 (Procter & Gamble). For enhancement of oily/fatty soil removal it is desirable to incorporate at least some dibutyl phthalate, whilst for optimum peroxyacid stability, saturated aliphatic tertiary alcohols are one preferred class of such component.

In general, the organic non-surfactant solvents may be selected from ethers, polyethers, alkyl (or fatty) amides and mono- and di- N-alkyl substituted derivatives thereof, alkyl (or fatty) carboxylic acid lower alkyl esters, and glycerides. Specific example include respectively, di-alkyl ethers, polyethylene glycols, alkyl ketones (such as acetone) and glyceryl trialkylcarboxylates (such as glyceryl tri-acetate), glycerol, propylene glycol, and sorbitol.

Many light solvents with little or no hydrophilic character may also be used. Examples of these are lower alcohols, such as ethanol, or higher alcohols, such as dodecanol, as well as alkanes. They may also be used in combination with other solvents such as described in the preceding paragraph.

Although the organic peroxyacid bleaches are present at a minimum of 0.1% by weight of the total composition, preferably they are used at at least 2.5%. Any peroxyacid bleach (including mixtures thereof) may be used and ideally it should be substantially totally soluble at the relevant concentration in the liquid solvent phase.

Preferably, the compositions also contain minor quantities of stabilisers for the peroxyacid bleach, e.g. as described in U.S. Pat. No. 3,956,159. One such agent is dipicolinic acid.

Typically, the peroxyacid bleach will be selected from the organic peroxyacids and water-soluble salts thereof having the general formula

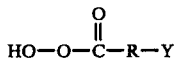

wherein R is an alkylene or substituted alkylene group containing 1 to 20 carbon atoms or an arylene group containing from 6 to 8 carbon atoms, and Y is hydrogen, halogen, alkyl, aryl or any group which provides an anionic moiety in aqueous solution. Such Y groups can include, for example:

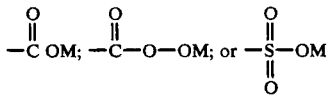

wherein M is H or a water-soluble, salt-forming cation.

The organic peroxyacids and salts thereof usable in the present invention can contain either one, two or more peroxy groups and can be either aliphatic or aromatic. When the orgainic peroxyacid is aliphatic, the unsubstituted acid may have the general formula:

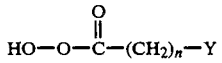

wherein Y can be H, $-CH_3$, $-CH_2Cl$,

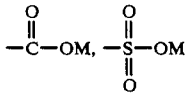

or

O —C—O—OM and n can be an integer from 6 to 20.

Peroxydodecanoic acids, peroxytetradecanoic acids and peroxyhexadecanoic acids are the most preferred compounds of this type, particularly 1,12-diperoxydodecandioic acid (sometimes known as DPDA), 1,14-diperoxytetradecandioic acid and 1,16-diperoxyhexadecandioic acid. Examples of other preferred compounds of this type are diperoxyazelaic acid, diperoxyadipic and diperoxysebacic acid.

When the organic peroxyacid is aromatic, the unsubstituted acid may have the general formula:

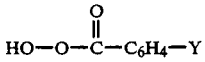

wherein Y is, for example hydrogen, halogen, alkyl,

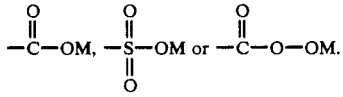

The percarboxy and Y groupings can be in any relative position around the aromatic ring. The ring and/or Y group (if alkyl) can contain any non-interfering substituents such as halogen or sulphonate groups. Examples of suitable aromatic peroxyacids and salts thereof include monoperoxyphthalic acid, diperoxyterephthalic acid, 4-chlorodiperoxyphthalic acid, diperoxyisophthalic acid, peroxy benzoic acids and ring-substituted peroxy benzoic acids, such as peroxy-alpha-naphthoic acid. A preferred aromatic peroxyacid is diperoxyisophthalic acid.

When the compositions of the present invention are intended for hard surface cleaning, they may also contain dispersed particles of abrasive. Also, although primarily intended as direct treatment products, they may also fulfil a dual function, e.g. as a pretreatment for fabrics and as a subsequent main wash agent. Thus, they may also contain other dispersed particulate solids such as are found in known cleaning products, e.g. for fabrics washing and machine warewashing. Of course in any event, the compositions of the present invention may also contain other conventional ingredients in solution.

When solid particles are a component of the compositions, they may be incorporated over a very wide range of amounts for example from 1–90%, usually from 10–80% and preferably from 15–70%, especially 15–50% by weight of the final composition. They should preferably have an average particle size of less than 300 microns, for example less than 200 microns, more preferably less than 100 microns, especially less than 10 microns. The particle size may even be of submicron size. The proper particle size can be obtained by using materials of the appropriate size or by milling the total product in a suitable milling apparatus.

The compositions are substantially non-aqueous, i.e. they little or no free water, preferably no more than 5%, preferably less than 3%, especially less than 1% by weight of the total composition.

Since the objective of a non-aqueous liquid will generally be to enable the formulator to avoid the negative influence of water on the components, e.g. causing incompatibility of functional ingredients, it is clearly necessary to avoid the accidental or deliberate addition of water to the product at any stage in its life.

For this reason, special precautions are necessary in manufacturing procedures and pack designs for use by the consumer.

Thus during manufacture, it is preferred that all raw materials should be dry and (in the case of hydratable salts) in a low hydration state. The surfactant and non-surfactant components of the liquid solvent phase may simply be admixed and the peroxyacid dissolved therein. However, if dispersed solids are to be included, the dry, substantially anhydrous solids are blended with the solvent in a dry vessel. In order to minimise the rate of sedimentation of the solids, this blend is passed through a grinding mill or a combination of mills, e.g. a colloid mill, a corundum disc mill, a horizontal or vertical agitated ball mill, to achieve a particle size of 0.1 to 100 microns, preferably 0.5 to 50 microns, ideally 1 to 10 microns. A preferred combination of such mills is a colloid mill followed by a horizontal ball mill since these can be operated under the conditions required to provide a narrow size distribution in the final product. Of course particulate material already having the desired particle size need not be subjected to this procedure and if desired, can be incorporated during a later stage of processing.

During this milling procedure, the energy input results in a temperature rise in the product and the liberation of air entrapped in or between the particles of the solid ingredients. It is therefore highly desirable to mix any heat sensitive ingredients into the product after the milling stage and a subsequent cooling step. The peroxyacid may fall into this category. It may also be desirable to de-aerate the product before addition of these (usually minor) ingredients and optionally, at any other stage of the process. Other typical ingredients which might be added at this stage are perfumes and enzymes, but might also include highly temperature sensitive bleach components or volatile solvent components which may be desirable in the final composition. However, it is especially preferred that volatile material be introduced after any step of aeration. Suitable equipment for cooling (e.g. heat exchangers) and de-aeration will be known to those skilled in the art.

It follows that all equipment used in this process should be completely dry, special care being taken after any cleaning operations. The same is true for subsequent storage and packing equipment.

In the case when it is desired to incorporate particulate solids, these can be maintained in dispersion (i.e. resist settling, even if not perfectly) by a number of means. Any means known to those skilled in the art may be utilised or that described in the applicants'European patent specification No. 266199-A.

It is a requirement of the present invention that the solvent phase is liquid and the peroxyacid is substantially all dissolved therein. However, all other ingredients before incorporation will either be liquid, in which case, in the composition they will constitute all or part of the liquid phase, or they will be solids, in which case, in the composition they will either be dispersed as deflocculated particles in the liquid phase. Thus as used herein, the term "solids" is to be construed as referring to materials in the solid phase which are added to the composition and are dispersed therein in solid form, those solids which dissolve in the liquid phase and those in the liquid phase which solidify (undergo a phase change) in the composition, wherein they are then dispersed.

The compositions according to the invention may contain other surfactans, either solid or liquid surfactants. Thus, it is possible to disperse or dissolve minor quantities of solid surfactants in the liquid phase. Also, some surfactants are also eminently suitable as deflocculants for solids.

In general however, the further surfactant material may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, München & Wien, 1981. Of course, the further surfactant material is in addition to the at least one capped nonionic.

Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols, preferably having from 8 to 20 carbon atoms. The capped derivatives of these are an essential component of the present invention. Others known are the monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and dialkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in the applicants'published European specification EP-A-No. 225,654, especially for use as all or part of the solvent. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the solvent.

Another class of suitable nonionics which may be included in minor quantities comprise the alkyl polysaccharides (polyglycosides/oligosaccharides) such as described in any of specifications U.S. Pat. Nos. 3,640,998; 3,346,558; 4,223,129; EP-A-Nos. 92,355; 99,183; 70,074, '75, '76, '77; 75,994, '95, '96.

Nonionic detergent surfactants normally have molecular weights of from about 300 to about 11,000. Mixtures of different nonionic detergent surfactants may also be used, provided the mixture is liquid at room temperature. Mixtures of nonionic detergent surfactants with other detergent surfactants such as anionic, cationic or ampholytic detergent surfactants and soaps may also be used.

Examples of anionic detergent surfactants are alkali metal, ammonium or alkylolamaine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, olefin sulphonates prepared by sulphonation of $C_{10}$–$C_{24}$ alpha-olefins and subsequent neutralization and hydrolysis of the sulphonation reaction product.

Other surfactants which may be incorporated include alkali metal soaps of a fatty acid, preferably one containing 12 to 18 carbon atoms. Typical such acids are oleic acid, ricinoleic acid and fatty acids derived from caster oil, rapeseed oil, groundnut oil, coconut oil, palmkernal oil or mixtures thereof. The sodium or potassium soaps of these acids can be used. As well as fulfilling the role of surfactants, soaps can act as detergency builders or fabric conditioners, other examples of which will be described in more detail hereinbelow. It can also be remarked that the oils mentioned in this paragraph may themselves constitute all or part of the solvent, whilst the corresponding low molecular weight fatty acids (triglycerides) can be dispersed as solids or function as structurants.

Yet again, it is also possible to utilise small amounts of cationic, zwitterionic and amphoteric surfactants such as referred to in the general surfactant texts referred to hereinbefore. Examples of cationic detergent surfactants are aliphatic or aromatic alkyl-di(alkyl) ammonium halides and examples of soaps are the alkali metal salts of $C_{12}$–$C_{24}$ fatty acids. Ampholytic detergent surfactants are e.g. the sulphobetaines. Combinations of surfactants from within the same, or from different classes may be employed to advantage for optimising structuring and/or cleaning performance.

When the compositions contain dispersed solids, preferably also, they contain a deflocculant (as hereinbefore defined) which may be any of those referred to in the published prior art or any described in the applicants EP No. 266199A related above. In some or many systems, the peroxyacids may themselves fulfil the role of deflocculant.

Other than the liquid phase and peroxyacid bleach, the compositions according to the present invention may also contain one or more other functional ingredients, for example selected from detergency builders, and other bleaches or bleach systems, and (for hard surface cleaners) abrasives.

The detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aliminosilicate-type materals, particularly the alkali-metal salt forms. Mixtures of these may also be used.

Examples of phosphorus-containing inorganic builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, metasilicates, and crystalline and amorphous alumino silicates. Specific examples include sodium carbonate (with or without calcite seeds), potassium carbonate, sodium and potassium bicarbonates, silicates and zeolites.

Examples of organic builders include the alkali metal, ammonium and substituted, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/-polymaleic acid co-polymers as their alkalimetal salts, such as those sold by BASF under the Sokalan Trade Mark.

The aluminosilicates are an especially preferred class of non-phosphorus inorganic builders. These for example are crystalline or amorphous materials having the general formula:

$$Na_Z(AlO_2)_Z(SiO_2)_Y x\ H_2O$$

wherein Z and Y are integers of at least 6, the molar ratio of Z to Y is in the range from 1.0 to 0.5, and x is an integer from 6 to 189 such that the moisture content is from about 4% to about 20% by weight (termed herein, 'partially hydrated'). This water content provides the best rheological properties in the liquid. Above this level (e.g. from about 19% to about 28% by weight water content), the water level can lead to network formation. Below this level (e.g. from 0 to about 6% by weight water content), trapped gas in pores of the material can be displaced which causes gassing and tends to lead to a viscosity increase also. However, it will be recalled that anhydrous materials (i.e. with 0 to about 6% by weight of water) can be used as structurants. The preferred range of aluminosilicate is from about 12% to about 30% on an anhydrous basis. The aluminosilicate preferably has a particle size of from 0.1 to 100 microns, ideally betweeen 0.1 and 10 microns and a calcium ion exchange capacity of at least 200 mg calcium carbonate/g.

Although in most cases, the peroxyacid bleaches are themselves sufficient, it is also possible to include the halogen, particularly chlorine bleaches such as are provided in the form of alkalimetal hypohalites, e.g. hypochlorites. In the application of fabrics washing though, the oxygen bleaches are preferred.

Thus, in addition to the dissolved peroxyacid bleach, it is possible to include also, an inorganic persalt bleach with a precursor therefore. The precursor makes the bleaching more effective at lower temperatures, i.e. in the range from ambient temperature to about 60° C., so that such bleach systems are commonly known as low-temperature bleach systems and are well known in the art. The inorganic persalt such as sodium perborate, both the monohydrate and the tetrahydrate, acts to release active oxygen in solution, and the precursor is usually an organic compound having one or more reactive acyl residues, which cause the formation of peracids, the latter providing for a more effective bleaching action at lower temperatures than the peroxybleach compound alone. The ratio by weight of the peroxy bleach compound to the precursor is from about 15:1 to about 2:1, preferably from about 10:1 to about 3.5:1. Whilst the amount of the bleach system, i.e. peroxy bleach compound and precursor, may be varied between about 5% and about 35% by weight of the total liquid, it is preferred to use from about 6% to about 30% of the ingredients forming the bleach system. Thus, the preferred level of the peroxy bleach compound in the composition is between about 5.5% and about 27% by weight, while the preferred level of the precursor is between about 0.5% and about 40%, most preferably between about 1% and about 5% by weight.

Typical examples of the suitable peroxybleach compounds are alkalimetal peroborates, both tetrahydrates and monohydrates, alkali metal percarbonates, persilicates and perphosphates, of which sodium perborate is preferred.

Precursors for peroxy bleach compounds have been amply described in the literature, including in British patent specification Nos. 836,988, 855,735, 907,356, 907,358, 907,950, 1,003,310, and 1,246,339, U.S. Pat. Nos. 3,332,882, and 4,128,494, Canadian patent specification No. 844,481 and South African patent specification No. 68/6,344.

The exact mode of action of such precursors is not known, but it is believed that peracids are formed by reaction of the precursors with the inorganic peroxy compound, which peracids then liberate active-oxygen by decomposition.

They are generally compounds which contain N-acyl or O-acyl residues in the molecule and which exert their activating action on the peroxy compounds on contact with these in the washing liquor.

Typical examples of precursors within these groups are polyacylated alkylene diamines, such as N,N,N$^1$,N$^1$-tetraacetylethylene diamine (TAED) and N,N,N$^1$,N$^1$-tetraacetylmethylene diamine (TAMD); acylated glycolurils, such as tetraacetylgylcoluril (TAGU); triacetylcyanurate and sodium sulphophenyl ethyl carbonic acid ester.

A particularly preferred precursor is N,N,N$^1$,N$^1$-tetra- acetylethylene diamine (TAED).

Another class of peroxygen compounds which can be incorporated to enhance dispensing/dispersibility in water are the anhydrous perborates described for that purpose in the applicants'European patent specification EP-A-No. 217,454.

When the composition contains abrasives for hard surface cleaning (i.e. is a liquid abrasive cleaner), these will inevitably be incorporated as particulate solids. They may be those of the kind which are water insoluble, for example calcite. Suitable materials of this kind are disclosed in the applicants'patent specifications EP-A-Nos. 50,887; 80,221; 140,452; 214,540 and 9,942, which relate to such abrasives when suspended in aqueous media. Water soluble abrasives may also be used.

The compositions of the invention optionally may also contain one or more minor ingredients such as fabric conditioning agents, enzymes, perfumes (including deoperfumes), micro-biocides, colouring agents, fluorescers, soil-suspending agents (anti-redeposition agents), corrosion inhibitors, enzyme stabilizing agents, and lather depressants.

The invention will now be illustrated by way of the following examples.

EXAMPLES 1 TO 8

The following liquid compositions were prepared:

| Example No: Ingredient (%) | 1 | 2 | 3 | 4 | 5 | 6 | 7 | 8 |
|---|---|---|---|---|---|---|---|---|
| Surfactant | | | | | | | | |
| Rewopal MT 65[1] | 18.4 | | | | 46.4 | | | |
| Triton DF 12[2] | | 19.4 | | | | 48.0 | | |
| Tergitol 15-S-9[3] | | | 19.2 | | | | 47.7 | |
| Synperonic A7[4] | | | | 17.9 | | | | 45.6 |
| Solvent | | | | | | | | |
| t-Butyl alcohol | 31.2 | 30.9 | 31.0 | 31.5 | 19.7 | 19.2 | 19.2 | 20.0 |
| Ethylene gly- | 21.8 | 21.5 | 21.6 | 21.9 | 13.7 | 13.3 | 13.4 | 13.9 |

-continued

| Example No: Ingredient (%) | 1 | 2 | 3 | 4 | 5 | 6 | 7 | 8 |
|---|---|---|---|---|---|---|---|---|
| col diacetate | | | | | | | | |
| Glyceryl triacetate | 23.0 | 22.7 | 22.7 | 23.1 | 14.5 | 14.1 | 14.1 | 14.7 |
| Bleach system | | | | | | | | |
| DPDA[5] | 5.6 | 5.5 | 5.5 | 5.6 | 5.6 | 5.5 | 5.5 | 5.7 |
| Dipicolinic acid | | | | ← 0.01 → | | | | |

Notes
[1]Fatty alcohol polyethylene glycol methyl ether ex Rewo Chemicals Ltd.
[2]Alcohol ethoxylate $C_{10}$—$C_{12}$, 5-10EO, benzyl capped, ex Rohm & Hass.
[3]Secondary alcohol ethoxylate $C_{10}$—$C_{15}$, 9EO, ex Union Carbide.
[4]Alcohol ethoxylate $C_{13}$—$C_{15}$, 7EO, ex ICI.
[5]1, 12 diperoxydodecandioic acid.

The compositions were stored at 25° C. and the level of DPDA was measured after various periods of time. The results were as follows:

% DPDA REMAINING UPON STORAGE AT 25° C.

| time/days | Composition 1 | 2 | 3 | 4 |
|---|---|---|---|---|
| 1 | 5.45 | 5.5 | 4.95 | 5.37 |
| 4 | 5.35 | — | — | 4.97 |
| 11 | 4.97 | — | — | 4.18 |
| 16 | — | 5.13 | — | — |
| 18 | 5.12 | — | — | 3.1 |
| 28 | — | 4.93 | — | — |
| 31 | — | — | 4.43 | — |
| 39 | 4.95 | — | — | 2.08 |
| 43 | — | — | 3.43 | — |
| 44 | — | 4.45 | — | — |
| 55 | 4.88 | — | — | 1.86 |
| 59 | — | — | 2.95 | — |
| 67 | 4.65 | 4.18 | 2.78 | 1.63 |
| 83 | 4.55 | — | — | 1.65 |

| time/days | Composition 5 | 6 | 7 | 8 |
|---|---|---|---|---|
| 1 | 5.5 | 4.95 | 4.5 | 5.43 |
| 4 | 4.65 | — | — | 4.12 |
| 11 | 4.43 | — | — | 1.93 |
| 16 | — | 3.42 | — | — |
| 18 | 4.55 | — | — | 0.95 |
| 28 | — | 2.6 | — | — |
| 31 | — | — | 1.32 | — |
| 39 | 4.35 | — | — | 0.67 |
| 43 | — | — | 1.3 | — |
| 44 | — | 1.7 | — | — |
| 55 | 4.2 | — | — | 0.92 |
| 59 | — | — | 1.21 | — |
| 67 | 3.72 | 1.6 | 1.04 | 0.92 |
| 83 | 3.7 | — | — | 0.93 |

EXAMPLES 9 TO 12

Compositions were prepared according to Examples 1, 4, 5 and 8 above, except that the dipicolinic acid stabiliser was omitted. These compositions were designated Examples 9 to 12 respectively and were tested for storage stability as described above, with the following results:

| Example No: | 9 | 10 | 11 | 12 |
|---|---|---|---|---|
| % surfactant | 18.4 | 17.9 | 46.4 | 45.6 |
| Surfactant | Rewopal | Synperonic | Rewopal | Synperonic |
| % DPDA after | | | | |
| 1 day | 5.24 | 3.67 | 4.49 | 2.0 |
| 2 days | 5.24 | 3.5 | 4.42 | 1.51 |
| 21 days | 5.24 | 1.57 | 4.45 | 0.2 |

I claim:

1. A non-aqueous liquid cleaning composition comprising 10% to 100% by weight of a liquid phase and optionally up to 90% by weight solid particles dispersed in the liquid phase, said liquid phase comprising:

(i) from 0.1% to 50% by weight, based on the weight of the liquid phase, of a surfactant material selected from the group consisting of capped alkoxylated nonionic surfactants comprising saturated or unsaturated linear or branched fatty chain linked via one or more independently selected alkyleneoxy groups to a terminal group which is other than hydrogen and mixtures thereof with other surfactant materials, the balance of said liquid phase comprising a non-surfactant organic solvent; and (ii) at least 0.1% by weight based on the weight of the total composition, of an organic peroxyacid selected from the group consisting of organic peroxyacids having the formula:

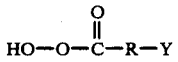

wherein R is an alkylene or substituted alkylene group containing 1 to 20 carbon atoms or an arylene group containing from 6 to 8 carbon atoms, and Y is hydrogen, halogen, alkyl, aryl or any group which provides an anionic moiety in aqueous solution and water soluble salts thereof dissolved in said liquid phase;

said composition containing substantially no undissolved peroxyacid.

2. A composition according to claim 1, wherein at least half of said surfactant material consists of at least one of said capped alkoxylated nonionic surfactants.

3. A composition according to claim 1, wherein substantially all of said surfactant material consists of at least one of said capped nonionic surfactants.

4. A composition according to claim 1, wherein said capped nonionic surfactant comprises an alkoxylated nonionic surfactant capped with a group selected from $C_1$ to $C_4$ alkyl groups.

5. A composition according to claim 1, wherein said non-surfactant organic solvent is selected from dibutylphthalate and saturated aliphatic tertiary alcohols.

6. A composition according to claim 1, wherein said organic peroxyacid comprises 1, 12 diperoxydodecandioic acid.

7. A composition according to claim 1, further comprising dipicolinic acid as a bleach stabiliser.

8. A composition according to claim 1, wherein said solid particles have an average particle size of less than 300 microns.

* * * * *